US007922011B2

(12) United States Patent
Knight et al.

(10) Patent No.: US 7,922,011 B2
(45) Date of Patent: Apr. 12, 2011

(54) MODULAR PIPE BASKET

(75) Inventors: Mark Knight, Lafayette, LA (US); Victor Benoit, Lafayette, LA (US)

(73) Assignee: Knight Oil Tools, Inc., Broussard, LA (US)

( * ) Notice: Subject to any disclaimer, the term of this patent is extended or adjusted under 35 U.S.C. 154(b) by 1 day.

(21) Appl. No.: 11/336,450

(22) Filed: Jan. 20, 2006

(65) Prior Publication Data

US 2006/0169617 A1 Aug. 3, 2006

Related U.S. Application Data

(60) Provisional application No. 60/645,451, filed on Jan. 20, 2005.

(51) Int. Cl.
*A47F 1/04* (2006.01)

(52) U.S. Cl. ..... 211/60.1; 211/70.4

(58) Field of Classification Search ..... 108/55.1, 108/55.3, 55.5; 248/346.02, 49; 211/60.01, 211/70.4, 88.01, 90.01, 103, 106, 106.1, 211/126.1–126.3, 133.1–133.3, 133.5, 133.6, 211/85, 18, 194, 126.6; 414/745.1
See application file for complete search history.

(56) References Cited

U.S. PATENT DOCUMENTS

| | | | | | |
|---|---|---|---|---|---|
| 2,046,095 | A * | 6/1936 | Shaw | 211/85.17 |
| 3,581,907 | A * | 6/1971 | Schmidt | 211/194 |
| 3,616,941 | A * | 11/1971 | Walling | 414/746.2 |
| 3,656,727 | A * | 4/1972 | Greenlee | 248/201 |
| 3,797,859 | A | 3/1974 | Vasquez | |
| 3,943,860 | A * | 3/1976 | Brennan | 108/55.5 |
| 3,945,497 | A * | 3/1976 | Greenberg | 211/70.4 |
| 3,978,994 | A * | 9/1976 | Woolslayer et al. | 414/22.62 |
| 4,380,297 | A * | 4/1983 | Frias | 211/70.4 |
| 4,494,899 | A | 1/1985 | Hoang et al. | |
| 4,725,179 | A * | 2/1988 | Woolslayer et al. | 414/22.65 |
| 4,989,731 | A * | 2/1991 | Shuert | 206/386 |
| 5,085,397 | A * | 2/1992 | Henkel | 248/688 |
| 5,188,503 | A * | 2/1993 | Appelberg | 414/745.1 |
| 5,233,931 | A * | 8/1993 | McCorkle, Jr. | 108/55.1 |
| 5,746,139 | A * | 5/1998 | Villanueva | 108/92 |
| 5,893,468 | A * | 4/1999 | Holmes | 211/60.1 |
| 6,202,863 | B1 * | 3/2001 | Grenier | 211/70.4 |
| 6,685,420 | B1 * | 2/2004 | Moser et al. | 414/422 |
| 6,742,825 | B1 | 6/2004 | Macaulay | |
| 7,069,706 | B2 * | 7/2006 | Hoogland | 53/171 |
| 7,267,060 | B1 * | 9/2007 | Moser et al. | 108/53.1 |
| 7,370,898 | B2 * | 5/2008 | Sturt et al. | 296/24.34 |
| 2005/0035618 | A1 * | 2/2005 | Toth et al. | 296/24.34 |
| 2007/0205170 | A1 * | 9/2007 | Gainer et al. | 211/119.005 |

OTHER PUBLICATIONS www.dictionary.com American Psychological Association (APA): stanchion. (n.d.). Dictionary.com Unabridged (v 1.1). Retrieved Jun. 29, 2009, from Dictionary.com website: http://dictionary.reference.com/browse/stanchion.*

* cited by examiner

*Primary Examiner* — Katherine Mitchell
*Assistant Examiner* — Candace L. Bradford
(74) *Attorney, Agent, or Firm* — John B. Edel; Kean, Miller, Hawthorne, D'Amor, McCowan & Jarman, LLP

(57) ABSTRACT

A modular pipe basket for transporting pipe is disclosed. The modular pipe basket will comprise a rectangular base, two or more stanchions and one or more end caps. In another embodiment, the modular pipe basket will incorporate a storage compartment or bin for storing miscellaneous piping accessories. In addition, the modular pipe basket may be equipped with a four point sling pickup system for lifting the basket with a crane along with the means for lifting the basket with a forklift.

3 Claims, 5 Drawing Sheets

MODULAR PIPE BASKET

CROSS REFERENCE TO RELATED APPLICATIONS

This application claims the benefit of prior U.S. provisional application Ser. No. 60/645,451 filed on Jan. 20, 2005.

STATEMENT REGARDING FEDERALLY SPONSORED RESEARCH OR DEVELOPMENT

Not applicable.

REFERENCE TO A "SEQUENCE LISTING," A TABLE, OR A COMPUTER PROGRAM

Not applicable

BACKGROUND OF THE INVENTION

1. Field of the Invention

The present invention relates to devices for transporting pipe. More particularly, the invention relates to a device for transporting drill pipe wherein the device is stackable and capable of being used in several modes of transportation.

2. Description of Related Art

A large volume of drilling pipe is used in oilfield drilling operations. As wells are drilled to ever greater depths, the number of sections of pipe required is continually increasing. The pipe is typically shipped loose and held together with slings. The modes of transportation for drill pipe are many, especially when the final destination is an offshore drilling rig. Starting from a pipe yard, the pipe will often be transported by both truck and boat before reaching the rig.

It is crucial that the drill pipe be kept stable and secure when it is transported. If the pipe load shifts on either a workboat or a truck the results can include an overturned trailer or a sunken vessel which could cause injury to workers, destruction of equipment and delayed delivery times. Many man-hours are expended in transporting individual drill pipe sections from one mode of transportation to another. The offloading of pipe from the boat to the rig is inherently dangerous, especially when the seas are rough. It would be a valuable savings in man-hours and a marked safety achievement if multiple sections of drill pipe could be moved in a systematic, uniform, and safe manner. Although utilizing the pipe basket will result in an increase in freight expenditures, the overall cost savings associated with utilizing the pipe basket will far outweigh the additional freight expenditure due to the pipe basket's safety advantages.

It is an object of the present invention to provide a modular pipe basket which is capable of holding multiple pipe sections.

It is another object of the present invention to provide a basket which can be stacked on another basket.

It is another object of the present invention to protect the ends of the pipe from damage.

It is another object of the invention to provide a basket which securely holds the pipe sections within the basket while maintaining the center of gravity at approximately the midpoint of the basket.

It is another object of the invention to provide a basket which has a balanced four point sling pickup system to enable stable lifting of the pipe basket with a crane or other like lifting means.

It is another object of the invention to provide a basket that will enable lifting of the pipe basket with a forklift or other like lifting means.

It is another object of the invention to provide a basket which has open side access to enable loading or unloading of pipe sections from the basket with either a forklift, crane or other lifting means.

It is another object of the invention to provide a basket that is compatible with truck and boat transportation and which can be moved between these two modes of transportation with relative ease.

It is another object of the invention to provide a basket which can include at least one container or bin for pipe thread protectors.

BRIEF SUMMARY OF THE INVENTION

The present invention is a modular pipe basket. The basket includes at least two stanchions, a rectangular base, and two end caps. In a preferred embodiment, the base has longitudinal members and cross members. In a particularly preferred embodiment, the device will include at least one bin, and the bin will include an integrated end cap.

A pipe basket described herein may for example comprise: an elongate first base member having a first end, a second end, and a midpoint; an elongate second base member having a first end, a second end, and a midpoint; wherein the base members are substantially equal in length; the second base member lies along a line which is substantially parallel to the first base member; the second base member is positioned along the line such that the distance between the first end of the first base member and the first end of the second base member is minimized; wherein the first base member is connected to the second base member by one or more connecting members; a first stanchion connected to the first base member at a point central to the first end of the first base member and the midpoint of the first base member; wherein the first stanchion is substantially free standing at its upper extent; a second stanchion connected to the first base member at a point central to the second end of the first base member and the midpoint of the first base member; wherein the second stanchion is substantially free standing at its upper extent; a third stanchion connected to the second base member at a point central to the first end of the second base member and the midpoint of the second base member; wherein the third stanchion is substantially free standing at its upper extent; a fourth stanchion connected to the second base member at a point central to the second end of the second base member and the midpoint of the second base member; wherein the fourth stanchion is substantially free standing at its upper extent; wherein the first stanchion, the second stanchion, the third stanchion, and the fourth stanchion are each substantially parallel to one another; a first receiving socket positioned on the first base member opposite the first stanchion; a second receiving socket positioned on the first base member opposite the second stanchion; a third receiving socket positioned on the second base member opposite the third stanchion; a fourth receiving socket positioned on the second base member opposite the fourth stanchion; wherein the basket is capable of stable stacking on top of a similar second basket such that the first receiving socket, the second receiving socket, the third receiving socket, and the fourth receiving socket receive a first stanchion of the similar second basket, a second stanchion of the similar second basket, a third stanchion of the similar second basket, and a fourth stanchion of the similar second basket respectively; wherein a cargo space is represented by a rectangular parallelepiped having a height equivalent to and coextensive with the height of the first stanchion, having a width equivalent to and coextensive with the width between the first stanchion and the third stanchion, and having a length that both passes through and extends beyond the plane occupied by the first stanchion and the third stanchion and that passes through and extends beyond the plane occupied by the second stanchion and the fourth stanchion; wherein the full height of the cargo space is accessible in an area between the first stanchion and the second stanchion; wherein the full height of the cargo space is accessible in an area between the first stanchion and the first end of the first base member; wherein the full height of the cargo space is accessible in an area between the second stanchion and the second end of the first base member; and wherein the connecting members are capable of supporting the weight of a quantity of drill pipe sufficient to fill the cargo space. In a further embodiment of the invention the pipe basket is arranged and configured such that when the sockets are resting on a surface a forklift on the surface can access the cargo area from between the first stanchion and the second stanchion such that the forklift can lift a pipe of a length substantially equivalent to the length of the cargo area vertically out of the cargo area then remove the pipe from the area above the basket by passing the pipe through the plane occupied by the first stanchion and the second stanchion. The methods described herein may, for example comprise, loading one or more drilling pipes onto the cargo space of the above described basket, securing the drilling pipes to the basket with one or more tensioning devices, transporting the basket to a second location, releasing the tensioning devices, and unloading the drilling pipe from the cargo space.

The modular pipe basket of the present invention has several advantages over the prior art systems. One advantage of the present invention is that the baskets are stackable.

Another advantage of the present invention is that the basket can accommodate different size pipes.

Another advantage of the present invention is that the basket will allow for centering of the drill pipe sections so that the center of gravity will be located at the midpoint of the basket.

Another advantage of the present invention is that the basket can accommodate various components associated with the drill pipe sections such as pipe end caps and wood strips which will be stored in the bin located at one or both ends of the pipe basket.

Still another advantage of the present invention is that the end cap of the basket will provide a backstop for potential load shifts of the pipe sections.

These and other objects, advantages, and features of this invention will be apparent from the following description.

DETAILED DESCRIPTION OF THE INVENTION

Figure 2:
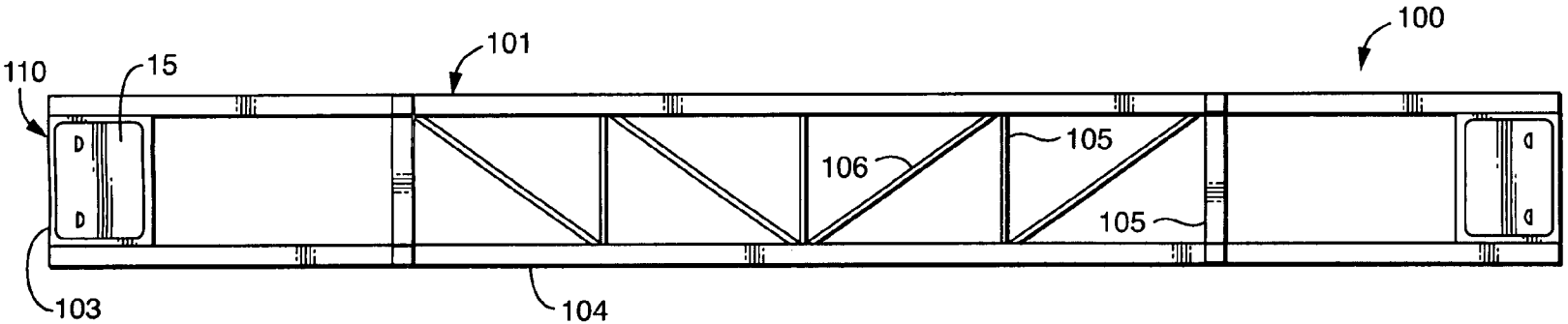
FIG. 2 is a top view of the preferred embodiment of the invention.
Figure 1:
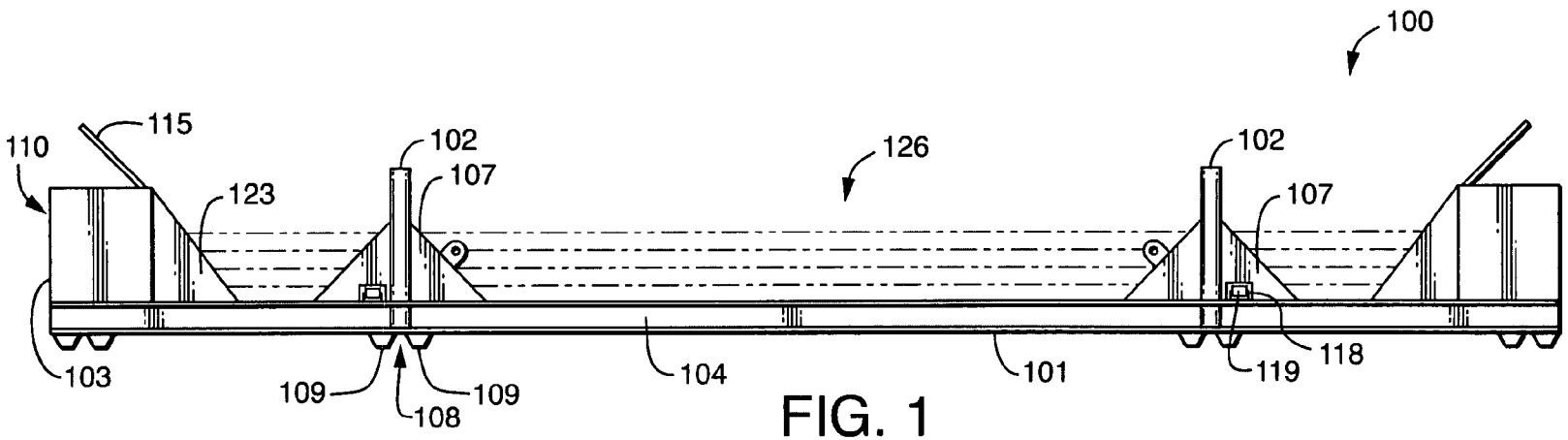
FIG. 1 is a side view of the preferred embodiment of the invention.

As shown in FIG. 1-2, modular pipe basket 100 includes base 101, stanchions 102, and end caps 103. Base 101 has two ends and is rectangular. Base 101 includes longitudinal members 104, cross members 105, and support members 106. Cross members 105 are welded to longitudinal members 104 and are substantially perpendicular to longitudinal members 104. In a preferred embodiment, support members 106 bridge between longitudinal members 104 and cross members 105 diagonally (i.e. at angles which are not right angles) so as to provide the maximum strength and rigidity to base 101.

In the embodiment depicted in FIG. 2, base 101 includes only two longitudinal members 104, but those skilled in the art may wish to include two or more longitudinal members 104. Similarly, while the figures show the use of five pairs of cross members 105 (three pairs in the midsection and one pair at each cap), those skilled in the art may wish to employ a different number of cross members 105 so long as cross members will support the pipe held in basket 100. For weight savings, longitudinal members 104, cross members 105, and support members 106 are rigid round or square tubing or rigid beams which are joined together either by welding or other fastening means. Those skilled in the art could construct base 101 in other configurations, such as using a solid sheet of steel.

In a preferred embodiment, basket 100 will include at least two (one on each side) stanchions 102. Stanchions 102 project upwards from longitudinal members 104 wherein stanchion 102 is in a plane that is substantially perpendicular to said base. The upper extent of stanchion 102 is free standing and stanchions 102 are placed such that a forklift may access the basket with the forks of said forklift entering between said at least two stanchions 102 and operating to lift a basket cargo out of the interior area of the basket. Stanchion 102 can be made of square or round tubing; beam material; or other equivalent structure. For maximum strength, each connection between stanchion 102 and longitudinal member 104 is reinforced with stanchion support 107. Stanchion supports 107 are cut in a roughly triangular shape and then welded to stanchion 102 and longitudinal member 104. It would be obvious to one skilled in the art to use another method of bracing stanchion 102 such as using a metal beam or other like structure. In another preferred embodiment, footings 109 are placed at the bottom of the base 101 in spaced pairs so as to create recesses 108 between each pair of footings 109. Recess 108 formed by pair of footings 109 allow top of each stanchion 102 on bottom pipe basket 100 to fit into recess 108 when stacking basket 100. The footings 109 are configured around the recesses 108 in a configuration that creates sockets for receiving the stanchions 102 of a similar second basket. Footing 109 may or may not extend across the entire width of the base. Footing 109 will also elevate basket 100 from ground level so as to provide a space underneath base 101 for forklift forks to slide under basket 100 for lifting of basket 100. It would be obvious to one skilled in the art to use a means for receiving forklift forks without footing 109 by creating at least one aperture in the side of base 101 for receiving forklift forks.

Basket 100 will also include two end caps 103. Each end cap 103 provides a means to stop and prevent pipe from sliding out of either end of basket 100. For example, if basket 100 were being carried on a typical flatbed truck trailer and the truck had to make a sudden stop, end cap 103 would prevent the pipe from sliding forward and endangering the truck driver. In addition, the end cap will have ability to prevent damage to the ends of the pipes when transporting and storing the pipe in pipe basket 100. End cap 103 should be constructed of steel plate, corrugated metal, expanded metal, or any material or design that will perform the desired function of arresting the sliding movement of the drill pipe.

Figure 3:
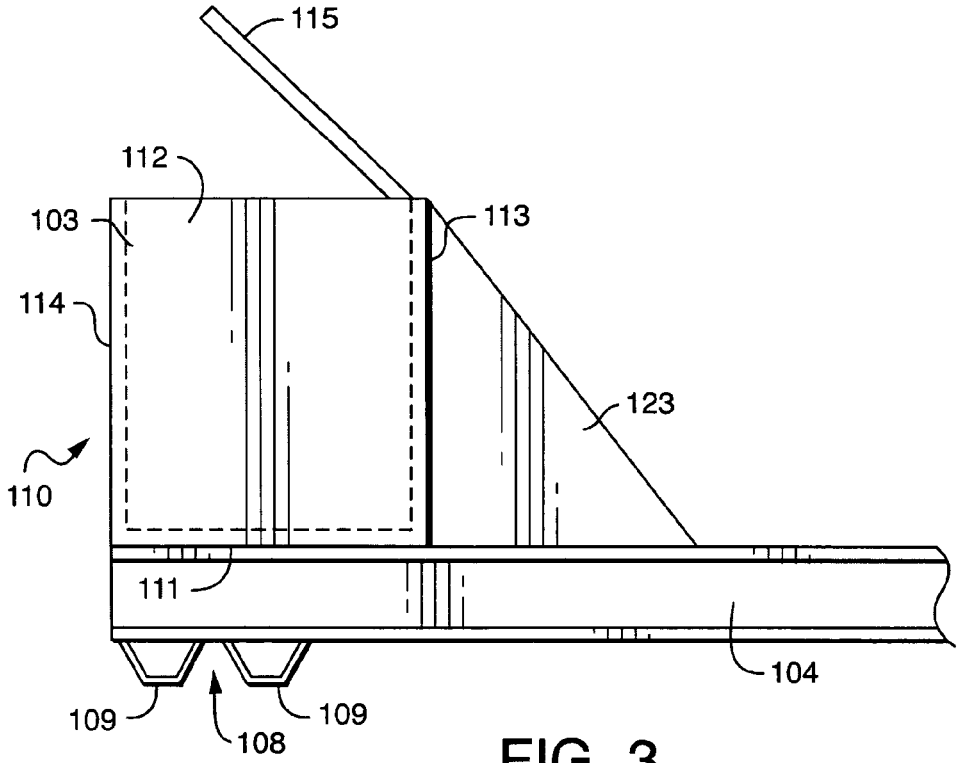
FIG. 3 is a fragmentary side view of one of the bins with the bin top in the open position.

In a particularly preferred embodiment, basket 100 will include at least one bin 110 which will have integrated therein an end cap 103 to stop the pipe from sliding as shown in FIG. 3. Bin supports 123 can be used to add strength and rigidity to the connection between bin 110 and longitudinal members 104. Alternatively, in the absence of bin 110, the bin supports 123 can be joined directly to the end cap 103 to add strength and rigidity to end cap 103. Additionally, bin 110 will provide storage space on pipe basket 100 and shall comprise end wall 114, two side walls 112, a front wall 113 and a bottom 111. Preferably, the end cap 103 will serve as end wall 114 for the bin, but those skilled in the art may wish to introduce end cap 103 independently from bin 110. Furthermore, those skilled in the art may wish to locate end cap 103 between bin 110 and pipe loading area 126. Typically, drill pipe is already threaded and thread protectors will be on the threaded sections of the drill pipe when the pipe is shipped. Although the bins can be used for various items, it is contemplated by the inventors that bin 110 will provide a convenient container for storage of the thread protectors and wood strips. Having bin 110 on basket 100 provides a way for the pipe purchaser to return the thread protectors, along with the basket, to the pipe seller.

Bin 110 will include bin bottom 111, which can be made of steel grate or expanded metal so as not to collect water. Bin 110 will also include side walls 112, front wall 113, and end wall 114. Bin 110 may also include lid 115. For added strength, bin 110 can be made by integrating beams into side walls 112, front wall 113, end wall 114, or bin bottom 111. In addition, any of the bin walls can be reinforced by ridge which can be created by bending the plate steel used to fabricate the walls. Bin 110 can also include lid 115. In a preferred embodiment, at least one bin wall shall be constructed of corrugated metal so as to provide increased strength and reduction of weight of pipe basket 100. To provide maximum strength to bin 110 and basket 100; side walls 112, front wall 113, and end wall 114 can be made from one piece of sheet steel which is bent at right angles to form bin 110. Also, square or round tubing or beam material can also be used to add support to bin 110 by providing a rigid frame for bin 110.

Figure 4:
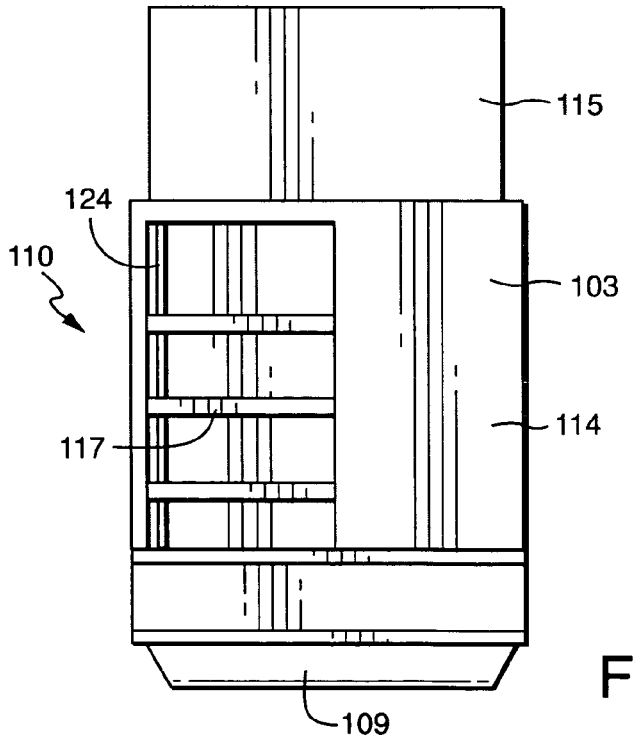
FIG. 4 is an end view of the invention depicting the ladder system.

To assist personnel in accessing the top of basket 100 and the inside of bin 110, bin 110 can also include an integrated ladder 117 as shown in FIG. 4. The ladder 117 would preferably be recessed into the end cap 103 so as not to protrude from the pipe basket 100. In addition, the ladder can be installed on each end cap 103 provided that the ladder 117 is incorporated on alternate sides from the ladder on the opposing end. This will allow ladder 117 on bottom basket to always line up with ladder 117 on the top basket in the event the baskets are stacked on top of each other. In addition, ladder hand support 124 can be installed to provide a hand grip for personnel climbing ladder 117.

Figure 5A:
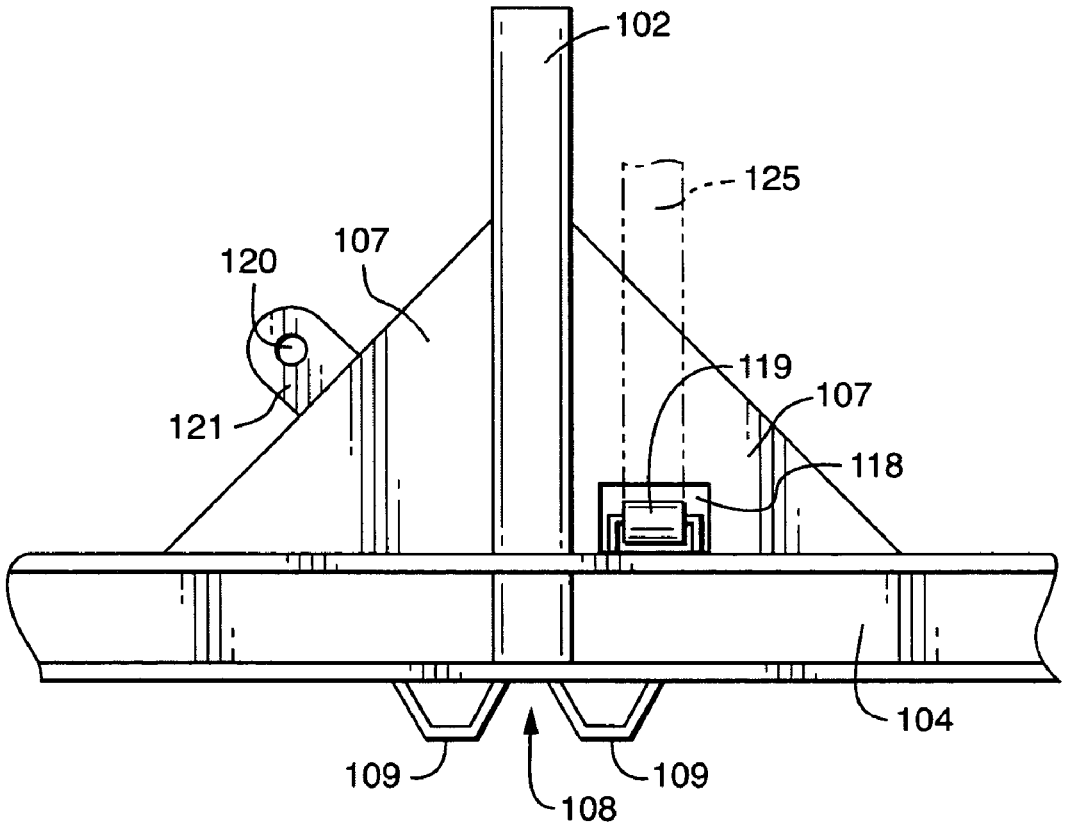
FIG. 5A is a fragmentary side view of a portion of the invention depicting the preferred embodiment of the stanchion system design with load securing means.
Figure 5B:
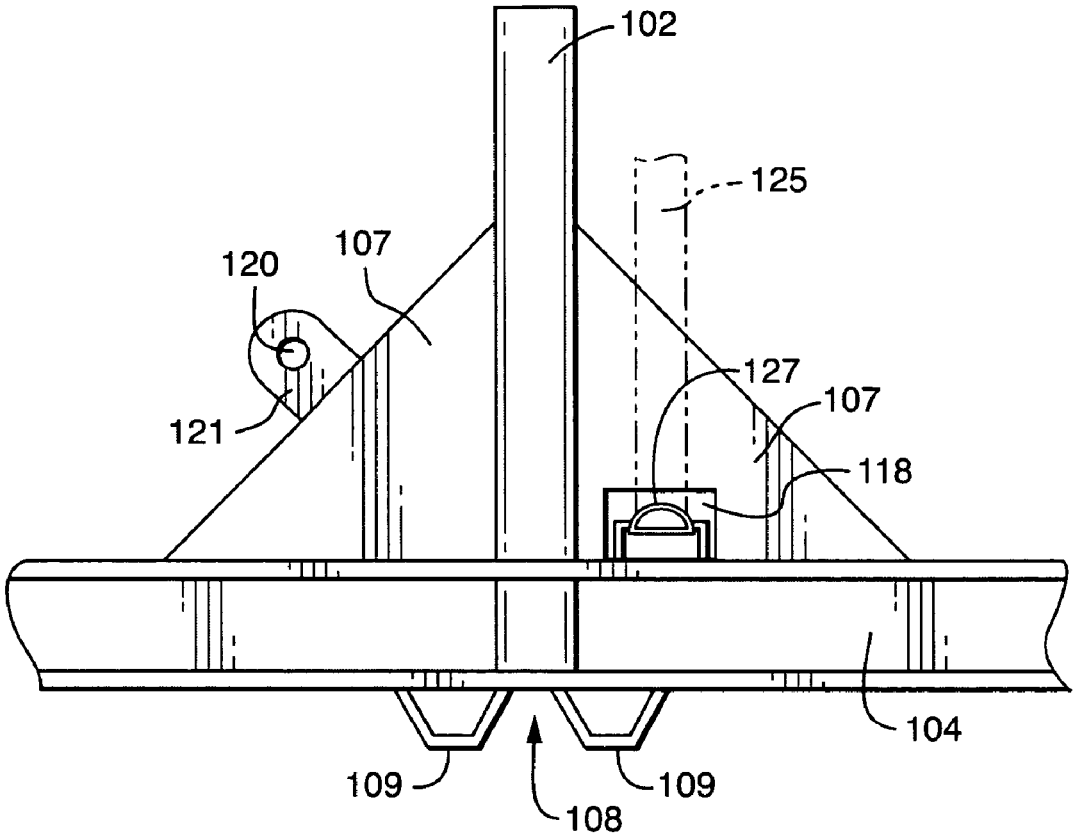
FIG. 5B is a reverse fragmentary side view of a portion of the invention depicting the preferred embodiment of the stanchion system design with strap receiver.

As shown in FIG. 1, one or more load securing points 118 can be placed along pipe basket 100. Preferably, load securing point 118 would be located within stanchion support 107 as shown in FIGS. 5A and 5B. More preferably, load securing point 118 would be provided in at least four points along the base 101; two along each alternate side of the pipe basket 100. At least one load securing means 119 can be placed on one side of pipe basket 101 at load securing point 118 wherein load securing means would preferably be a ratcheting apparatus or equivalent fastening means as shown in FIG. 5A. Although load securing means 119 is shown in an upright position in FIGS. 1, 5A and 6, a slight modification to the load securing point 118 can be made so that the load securing means 119 can be inverted thereby positioning the load securing means 119 upside down within load securing point 118. At least one strap receiver 127 will be placed on the opposite side from load securing means 119 to provide a connection for strap 125 as shown in FIG. 5B. The strap receiver 127 can be a hook, grapple, clasp, catch, or other equivalent securing means. Strap 125 will be used to hold the drill pipe securely in place during transport wherein such strap 125 can comprise of a cloth, metal or polymer strap, chain, cable or other like tie down means. In the stacked configuration shown in FIG. 6, one or more of the straps from the bottom basket 100 may be wrapped around the longitudinal members 104 or any part of the top basket 100 so as to secure the two baskets together during transport or storage.

To assist in safely lifting the pipe basket 100 with the use of a crane or other like lifting means, it would be preferable to use sling lifting brackets 121 which can be incorporated into the pipe basket 100 as shown in FIGS. 5A and 5B. Sling lifting brackets 121 are rigid members that preferably project diagonally (i.e. at angles which are not right angles) from longitudinal members 104 and are located at four different points along the pipe basket 100. However, the sling lifting brackets 121 can also project perpendicular or parallel from longitudinal members 104. Also shown in FIGS. 5A and 5B, sling lifting bracket 121 contains pad eye 119 which is an aperture placed in sling lifting bracket 121 so as to allow a connection point for the lifting slings of a crane or other like lifting device. Ideally, pad eyes are drilled, not cut, so as to provide superior strength for pad eyes 119 which are used as lift points. It would be obvious to one skilled in the art that pad eye 119 can also be a separate device that is joined to pipe basket 100. To lift basket 100, one may connect a sling to pad eye 119. The sling lifting brackets 121 are added to provide additional lifting support. It will be obvious to those skilled in the art that pad eyes could be placed at several points on basket 100 including but not limited to stanchion 102, stanchion support 107 and base 101. In addition, stanchion support 107 could serve as sling lifting bracket 121.

In a preferred embodiment, the material for all the components of the pipe basket 100 will be galvanized carbon steel to help reduce corrosion of pipe basket 100. In another preferred embodiment, longitudinal member 104 would be made of 10 inch thick beams to allow for adequate support of pipe basket 100.

By way of example only, pipe basket 100 could have a total length of 38 feet with a usable interior space that can accommodate pipe of up to 34 feet in length. The outer extent of the interior space is defined by the end caps 103, the stanchions 102, and base 101 of basket 100. Basket 100 can be made with a width of approximately four feet and a height of about 54 inches. With these dimensions, two baskets 100 can be placed side by side on a conventional truck trailer.

Figure 6:
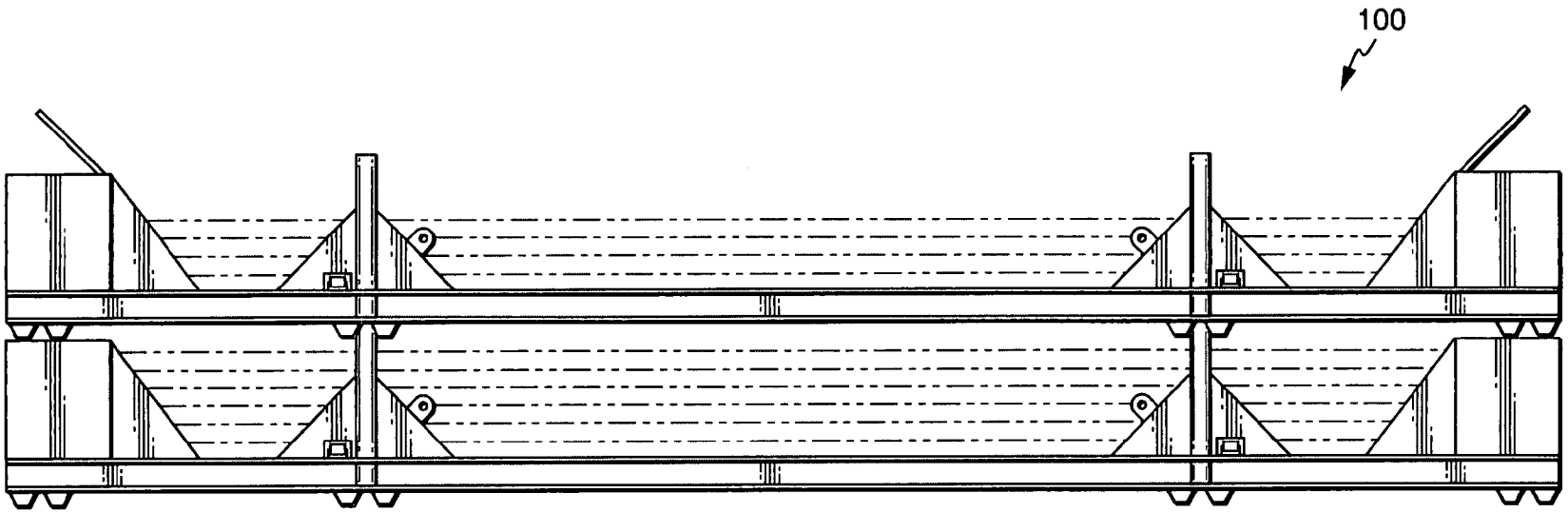
FIG. 6 is a side view of the invention depicting one pipe basket stacked on top of another.

In operation, basket 100 is loaded with drill pipe. Once basket 100 is loaded with the desired quantity of pipe, strap 125 can be tightened over the pipe using strap load securing points 118. As shown in FIG. 6, a first pipe basket 100 can be stacked on top of a second pipe basket 100. The two baskets can be secured together using the straps 125 and load securing means 119 or equivalent securing means. As the pipe loaded therein is used, any thread protectors on the pipe and wood stripping used to space the pipes can be placed in bin 110.

There are, of course, other alternate embodiments which are obvious from the foregoing descriptions of the invention, which are intended to be included within the scope of the invention, as defined by the following claims.

We claim:

1. A pipe basket comprising:

an elongate first base member having a first end, a second end, and a midpoint;

an elongate second base member having a first end, a second end, and a midpoint;

wherein the base members are substantially equal in length;

the second base member lies along a line which is substantially parallel to the first base member;

the second base member is positioned along the line such that the distance between the first end of the first base member and the first end of the second base member is minimized;

wherein the first base member is connected to the second base member by one or more connecting members;

a first stanchion connected to the first base member at a point central to the first end of the first base member and the midpoint of the first base member; wherein the first stanchion is substantially free standing at its upper extent;

a second stanchion connected to the first base member at a point central to the second end of the first base member and the midpoint of the first base member; wherein the second stanchion is substantially free standing at its upper extent;

a third stanchion connected to the second base member at a point central to the first end of the second base member and the midpoint of the second base member; wherein the third stanchion is substantially free standing at its upper extent;

a fourth stanchion connected to the second base member at a point central to the second end of the second base member and the midpoint of the second base member; wherein the fourth stanchion is substantially free standing at its upper extent;

wherein the first stanchion, the second stanchion, the third stanchion, and the fourth stanchion are each substantially parallel to one another;

a first receiving socket positioned on the first base member opposite the first stanchion;

a second receiving socket positioned on the first base member opposite the second stanchion;

a third receiving socket positioned on the second base member opposite the third stanchion;

a fourth receiving socket positioned on the second base member opposite the fourth stanchion;

wherein the pipe basket is capable of stable stacking on top of a similar second basket such that the first receiving socket, the second receiving socket, the third receiving socket, and the fourth receiving socket receive a first stanchion of the similar second basket, a second stanchion of the similar second basket, a third stanchion of the similar second basket, and a fourth stanchion of the similar second basket respectively;

wherein a cargo space is represented by a rectangular parallelepiped having a height equivalent to and coextensive with the height of the first stanchion, having a width equivalent to and coextensive with the width between the first stanchion and the third stanchion, and having a length that both passes through and extends beyond the plane occupied by the first stanchion and the third stanchion and that passes through and extends beyond the plane occupied by the second stanchion and the fourth stanchion;

wherein the full height of the cargo space is accessible in an area between the first stanchion and the second stanchion;

wherein the full height of the cargo space is accessible in an area between the first stanchion and the first end of the first base member;

wherein the full height of the cargo space is accessible in an area between the second stanchion and the second end of the first base member; and wherein the connecting members are capable of supporting the weight of a quantity of drill pipe sufficient to fill the cargo space, the drill pipes being useable in subsea and commercial drill operations.

2. The pipe basket of claim 1 wherein the pipe basket is arranged and configured such that when the sockets are resting on a surface a forklift on the surface can access the cargo area from between the first stanchion and the second stanchion such that the forklift can lift a pipe of a length substantially equivalent to the length of the cargo area vertically out of the cargo area then remove the pipe from the area above the basket by passing the pipe through the plane occupied by the first stanchion and the second stanchion.

3. A method of transporting drilling pipe comprising:

loading one or more drilling pipes onto the cargo space of the pipe basket of claim 1, securing the drilling pipes to the pipe basket of claim 1 with one or more tensioning devices, transporting the pipe basket of claim 1 to a second location, releasing the tensioning devices, and unloading the drilling pipes from the cargo space.

* * * * *